US005118598A

United States Patent [19]

Wolff

[11] Patent Number: 5,118,598

[45] Date of Patent: Jun. 2, 1992

[54] COLOR PHOTOGRAPHIC SILVER HALIDE MATERIAL HAVING A MAGENTA COUPLER AND AN OIL FORMER COMPOUND

[75] Inventor: Erich Wolff, Solingen, Fed. Rep. of Germany

[73] Assignee: Agfa Gevaert Aktiengesellschaft, Leverkusen, Fed. Rep. of Germany

[21] Appl. No.: 528,721

[22] Filed: May 24, 1990

[30] Foreign Application Priority Data

Jun. 7, 1989 [DE] Fed. Rep. of Germany ..... 3918547

[51] Int. Cl.[5] ..... G03C 7/388; G03C 7/38

[52] U.S. Cl. ..... 430/546; 430/551; 430/558

[58] Field of Search ..... 430/558, 551, 546

[56] References Cited

U.S. PATENT DOCUMENTS 4,562,146 12/1985 Masuda et al. ..... 430/551
4,656,125 4/1987 Renner et al. ..... 430/551
4,898,811 2/1990 Wolff et al. ..... 430/551

*Primary Examiner*—Charles L. Bowers, Jr.
*Assistant Examiner*—Lee C. Wright
*Attorney, Agent, or Firm*—Connolly and Hutz

[57] ABSTRACT

Color photographic silver halide material which contains in at least one silver halide emulsion layer a magenta coupler of the formulae (I) or (II)

(I) (II)

wherein $R_1$ denotes alkyl, aryl or a ballast radical, $R_2$ denotes a ballast radical, alkyl, or aryl and Z denotes hydrogen or a group which can be split off on reaction with the developer oxidation product, and a compound of the formula (III)

(III)

wherein $R_3$ denotes alkyl, alkoxy, aryl, optionally substituted amino or the radical of a heterocyclic compound and $R_4$ denotes alkyl, aryl or a heterocyclic radical, with the exception of the compound of the formula

5 Claims, No Drawings

COLOR PHOTOGRAPHIC SILVER HALIDE MATERIAL HAVING A MAGENTA COUPLER AND AN OIL FORMER COMPOUND

The invention relates to a color photographic silver halide material of high sensitivity and high color density, which has good spectral absorption properties, especially in the magenta range.

In color photographic based on photosensitive silver halides, the colors yellow, magenta and blue-green are formed by reaction of the developer oxidation product with the corresponding couplers. Pyrazolone compounds are usually employed as magenta couplers, but these create numerous problems. Firstly, they have an undesirable absorption in the wavelength range from 400 to 500 nm, in addition to the desired and predominant absorption in the range from 540 to 560 nm. Secondly, the dyestuffs prepared with these couplers exhibit a low maximum color density. Thirdly, the long-term stability of these couplers is unsatisfactory, since on prolonged storage, especially in the presence of the tiniest amounts of formaldehyde, non-exposed photographic material shows a change in color shade and a reduction in color formation during color development.

A large number of proposals have already been made to overcome these disadvantages, the most promising system comprising the use of magenta couplers of a different structure. In fact, it has been found that pyrazolotriazole magenta couplers do not exhibit undesirable absorption, are essentially resistant to formaldehyde and have a high color formation constancy. On the other hand, these couplers exhibit the disadvantage that only unstable dispersions, which are to be incorporated into the silver halide emulsions, can be prepared with them. Furthermore, the absorption wavelengths of the dyestuffs prepared with these couplers are shorter than the desired value.

In order to overcome these difficulties too, EP-A-145 342, in which there are a number of other literature references, proposes dispersion of pyrazolotriazole magenta couplers of a certain structure in certain phenolic compounds (so-called oil-forming agents) and incorporation of them in this form into the silver halide emulsion.

Although it is possible to eliminate the above mentioned difficulties to a certain degree in this manner, the proposed solutions suffer either from too low a sensitivity, too great a fog, too low a formaldehyde resistance or inadequate stability of the coupler dispersions prepared therefrom.

It has now been found that these difficulties can also be overcome if specific oil-forming agents are used for pyrazolotriazole magenta couplers.

The invention thus relates to as color photographic silver halide material which contains in at least one silver halide emulsion layer a magenta coupler of the formulae (I) or (II)

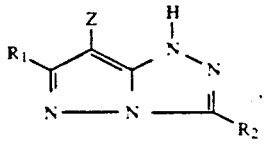

(I)

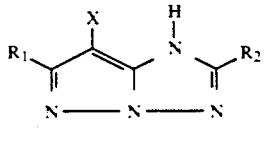

(II)

wherein $R_1$ denotes alkyl, aryl or a ballast radical, $R_2$ denotes a ballast radical, alkyl or aryl; and Z denotes hydrogen or a group which can be split off during reaction with the developer oxidation product, and a compound of the formula (III)

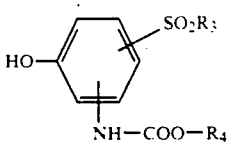

(III)

wherein $R_3$ denotes alkyl, alkoxy, aryl, optionally substituted amino or the radical of a heterocyclic compound; and $R_4$ denotes alkyl, aryl or a heterocyclic radical, with the exception of the compound of the formula

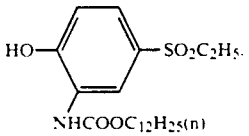

The alkyl radicals $R_1$ and $R_2$ have, in particular, 1 to 16 C atoms, e.g. methyl, ethyl, butyl, dodecyl, iso-propyl, tert.-butyl and iso-amyl, and can be substituted by halogen atoms, $C_1$-$C_4$-alkylsulphonyl groups or phenoxy groups, e.g. $CF_3$, $C_3F_7$ and $CH_3—SO_2—CH_2—CH_2—CH_2—$.

The aryl radicals $R_1$ and $R_2$ are, in particular, phenyl or naphthyl radicals which are optionally substituted by $C_1$-$C_4$-alkyl, halogen, $C_1$-$C_4$-alkoxy, $C_1$-$C_4$-alkylcarbonyl amino, $C_1$-$C_4$-alkylsulphonylamino, $C_1$-$C_4$-alkylsulphonyl or $C_1$-$C_4$-alkoxycarbonyl.

Preferably, either $R_1$ or $R_2$ is a ballast group.

The leaving group Z is preferably halogen, for example chlorine, bromine, iodine or fluorine, an aryloxy group, for example phenoxy, p-methoxyphenoxy, p-butanesulphonamidophenoxy or p-tert.-butylcarboamidophenoxy, an arylthio group, for example phenylthio, or a heterocyclic thio group, e.g. 1-ethyltetrazole-5-thiolyl. Z is preferably a halogen atom, in particular chlorine.

Ballast radicals are to be regarded as those radicals which enable the compounds according to the invention to be incorporated in a diffusion-resistant manner in the hydrophilic colloids customarily used in photographic materials. Radicals which are preferably suitable for this are organic radicals, which in general contains straight-chain or branched aliphatic groups and optionally also isocyclic or heterocyclic aromatic groups having in general 8-20 C atoms. These radicals are bonded either directly or indirectly to the remainder of the molecule, e.g. via one of the following groups: —NHCO—, —$NHSO_2$—, —NR—, wherein R denotes hydrogen or alkyl, —O— or —S—. In addition, the radical which renders the compounds diffusion-resistant can also contain groups which confer water-solubility, such as e.g. sulpho groups or carboxyl groups, which can also be in anionic form. Since the diffusion properties depend on the molecular size of the total compound used, in certain cases, e.g. if the total molecule used is large enough, it is also sufficient for shorter-chain radicals also to be used as ballast radicals.

The pyrazolotriazole coupler preferably corresponds to the formula (IV)

(IV)

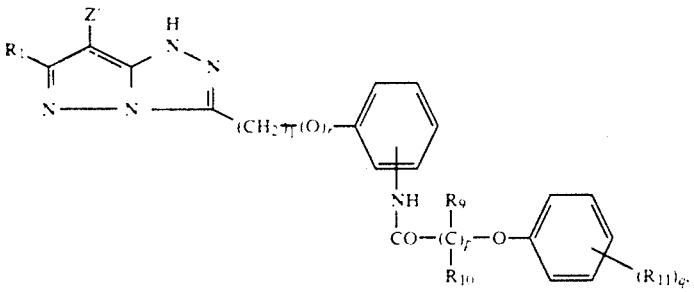

wherein

Z' is a group which is split off by reaction with the developer oxidation product, $R_9$ and $R_{10}$ denote hydrogen or alkyl, $R_{11}$ denotes alkyl, halogen or hydroxyl;

l, p and q denote a number from 0 to 4, and r denotes 0 or 1.

Preferably, l represents a number from 0 to 3, p represents a number from 1 to 3 and q represents 1 or 2.

Alkyl $R_3$ is, in particular, $C_1$-$C_6$-alkyl; alkoxy $R_3$ is, in particular, $C_1$-$C_4$-alkoxy; and aryl $R_3$ and $R_4$ is, in particular, phenyl or phenyl which is substituted by $C_1$-$C_4$-alkyl, $C_1$-$C_4$-alkoxy or halogen.

Optionally substituted amino $R_3$ is, in particular, amino, $C_1$-$C_{16}$-alkylamino, di-$C_1$-$C_{12}$-alkylamino, —NHCO—$R_5$, NHCO—heterocyclic, —NH—CO—$NHR_5$ or —$NHSO_2$—$R_5$, wherein $R_5$ denotes alkyl or aryl and heterocyclic has the following meaning:

Suitable heterocyclic radicals are, in particular, pyridyl and morpholinyl.

Alkyl $R_4$ is, in particular, $C_8$-$C_{30}$-alkyl, preferably $C_8$-$C_{30}$-alkyl having at least one branching and in particular alkyl of the formula

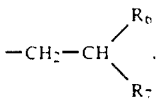

wherein $R_6$ and $R_7$ are straight-chain or branched alkyl radicals having in total 6 to 28 C atoms.

Typical examples of pyrazolotriazole magenta couplers according to the invention are listed below.

| Coupler | $R_1$ | $Z$ | $R_2$ |
|---|---|---|---|
| | | 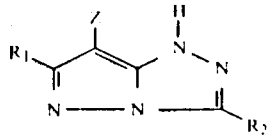 | (I) |
| C-1 | $CH_3$— | Cl— | 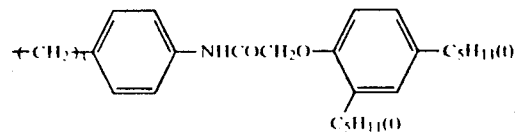 |
| C-2 | $CH_3$— | Cl— | 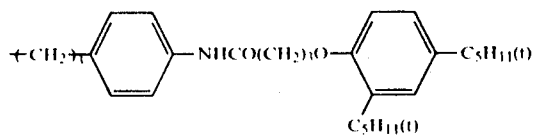 |
| C-3 | $CH_3$— | Cl— | 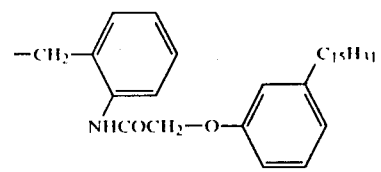 |
| C-4 | $CH_3$— | Cl— | 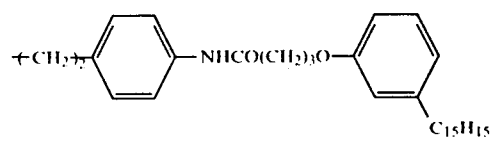 |
| C-5 | $CH_3$— | Cl— | 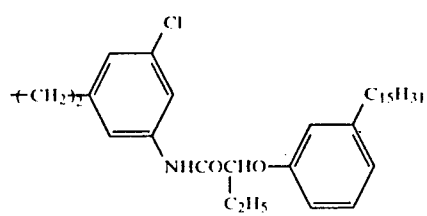 |

-continued
| Coupler | $R_1$ | Z | $R_2$ |
|---|---|---|---|
| C-6 |  | Cl— | 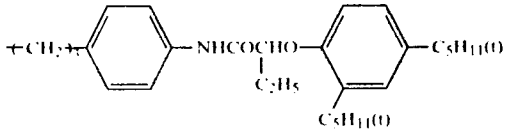 |
| C-7 | $CH_3$— | Cl— | 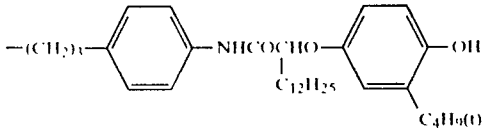 |
| C-8 | 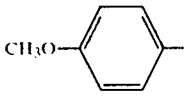 | Cl— | 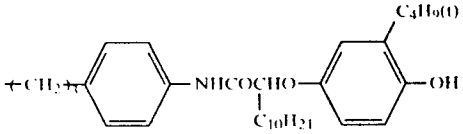 |
| C-9 | $CH_3$— | 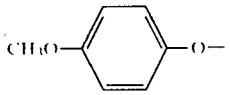 | 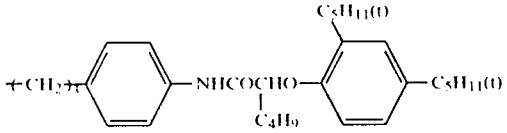 |
| C-10 | $CH_3$— | Cl— | 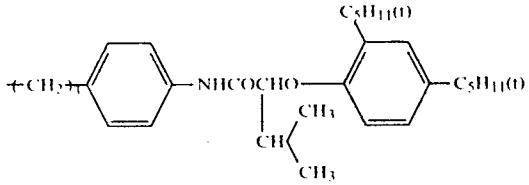 |
| C-11 | 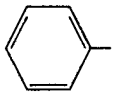 | Cl— | 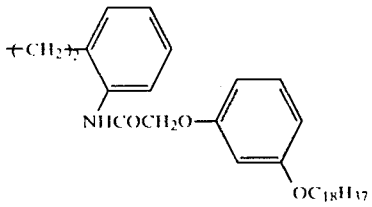 |

-continued

| Coupler | $R_1$ | Z | $R_2$ |
|---|---|---|---|
| C-12 | $CH_3-C(CH_3)_2-$ | Cl— | $+CH_2+_3$ — NHCOCHO($C_2H_5$) — $C_6H_3$($C_5H_{11}(t)$) — $C_5H_{11}(t)$ |
| C-13 | $CH_3$— | Cl— | $+CH_2+_3$ — $NHSO_2$ — $OC_{18}H_{37}$ |
| C-14 | $CH_3$— | Cl— | $+CH_2+_3$ — NHCOCHO($C_{10}H_{21}$) — $SO_2$ — OH |
| C-15 | $CH_3$— | H— | $C_6H_3$($C_5H_{11}(t)$) — NHCOCHO($C_2H_5$) — $C_5H_{11}(t)$ |
| C-16 | $CH_3-C(CH_3)_2-$ | H— | $-C_{18}H_{37}$ |
| C-17 | $CH_3$— | Cl— | $+CH_2+_3$ — NHCOCHO($C_{10}H_{21}$) — $SO_2$ — $C_6H_4$ — $OCH_2$ — $C_6H_5$ |
| C-18 | $CH_3$— | Cl— | $+CH_2+_3$ — NHCOCH($C_{12}H_{25}$)$SO_2CH_2$ — $C_6H_5$ |

-continued
| Coupler | $R_1$ | Z | $R_2$ |
|---|---|---|---|
| C-19 | 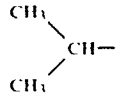 | 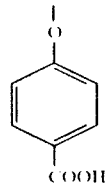 | 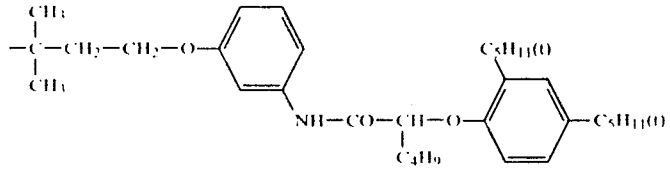 |
| C-20 | $CH_3$— | Cl— | 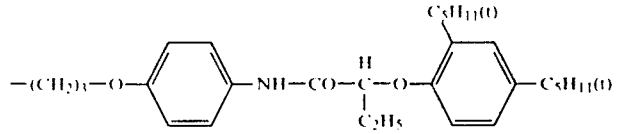 |
| C-21 | 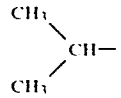 | 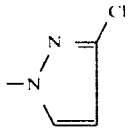 | 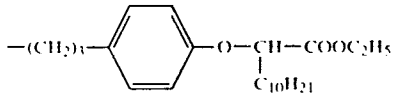 |
| C-22 | 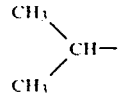 | —Cl | 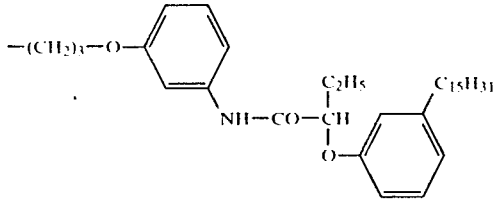 |
| C-23 | $CH_3$— | 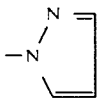 | 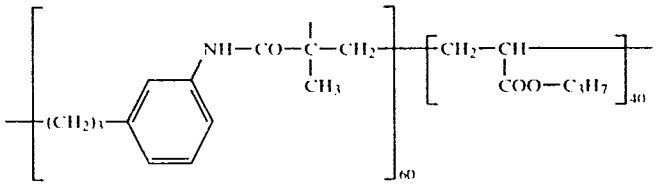 |

-continued
| Coupler | $R_1$ | Z | $R_2$ |
|---|---|---|---|
| C-24 | $CH_3-$ | 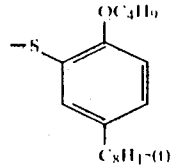 | 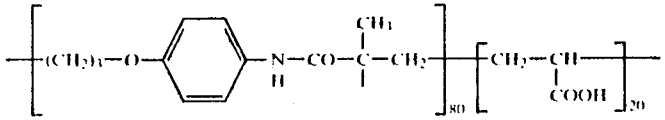 |
| C-25 | 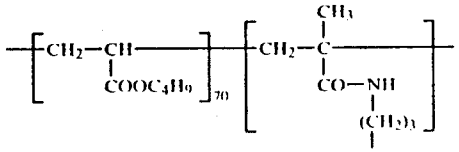 | Cl | 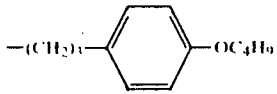 |
| C-26 | 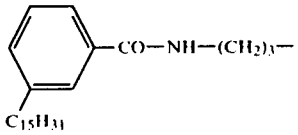 | 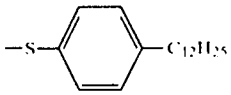 | $-C_4H_9$-(n) |
| C-27 | 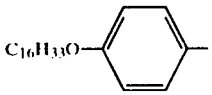 | 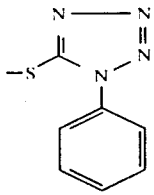 | $-C_3H_7$(n) |
| C-28 | 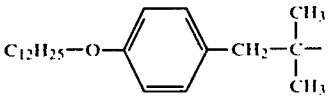 | 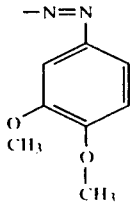 | $-C_3H_7$(n) |

-continued
| Coupler | $R_1$ | Z | $R_2$ |
|---|---|---|---|
| | | 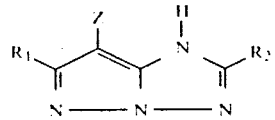 | (II) |
| C-29 | $CH_3$ | Cl | 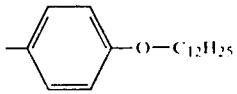 |
| C-30 | 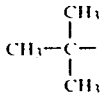 | Cl | 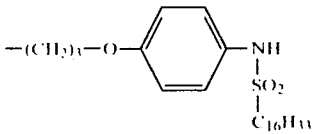 |
| C-31 | 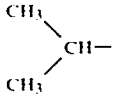 | 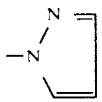 | 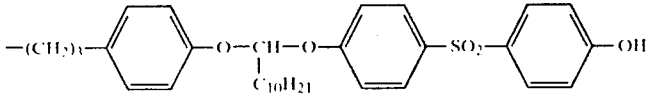 |
| C-32 | 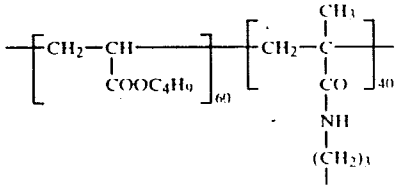 | Br | $-C_4H_9(n)$ |
| C-33 | 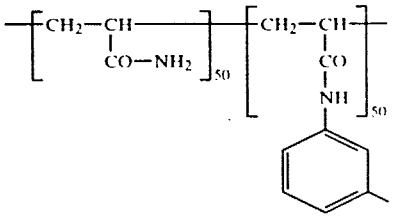 | 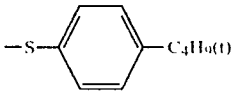 | $C_3H_7(i)$ |

-continued
| Coupler | $R_1$ | Z | $R_2$ |
|---|---|---|---|
| C-34 | 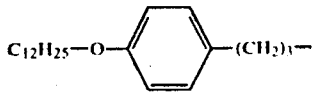 | 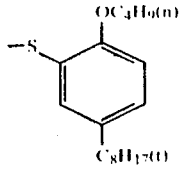 | 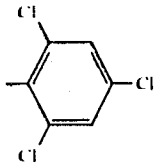 |
| C-35 | $CH_3-$ | Cl | 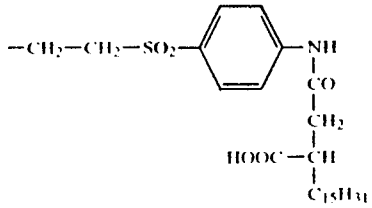 |
| C-36 | $CH_3$ | Cl | 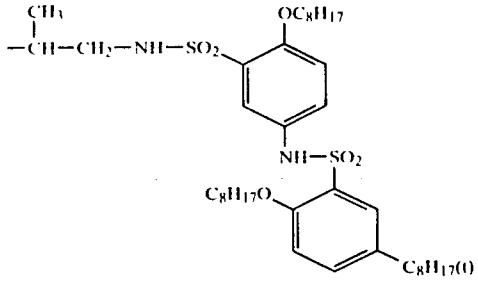 |
| C-37 | $-CH_3$ | $-NHCOCF_3$ | 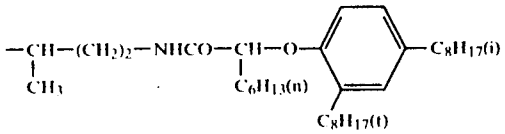 |
| C-38 | $-CH_3$ | $-O-CH(CH_3)_2$ | 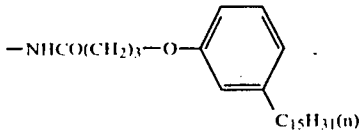 |

-continued
| Coupler | $R_1$ | Z | $R_2$ |
|---|---|---|---|
| C-39 | $-CH(CH_3)_2$ | $-Cl$ | 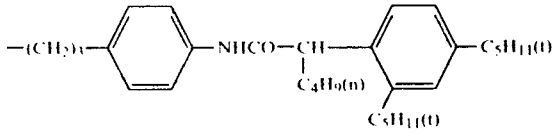 $-CH(CH_2-CH_3)_2$ |
| C-40 | 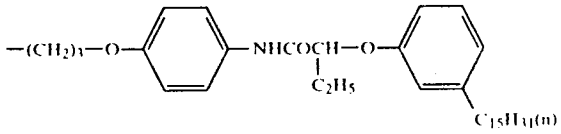 | 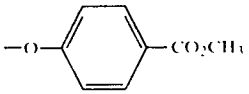 | |
| C-41 | $-C(CH_3)_3$ | $-Cl$ | 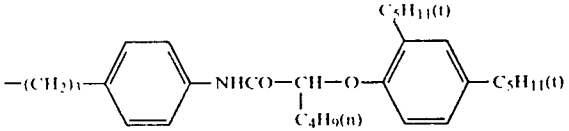 |
| C-42 | $-CBr(CH_3)_2$ | 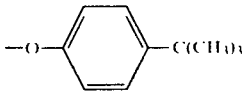 | 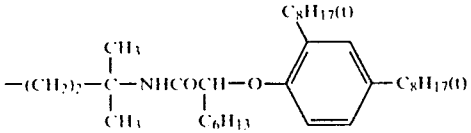 |
| C-43 | $-CH(C_2H_5)_2$ | $-NHCOC_3F_7(n)$ | 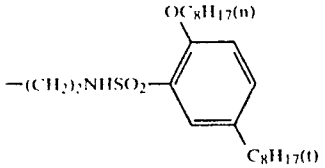 |
| C-44 | $-CH(CH_3)_2$ | $-Cl$ | 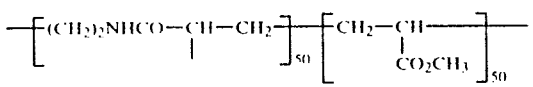 |
| C-45 | $-C(CH_3)_3$ | 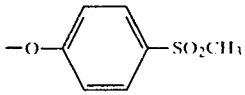 | 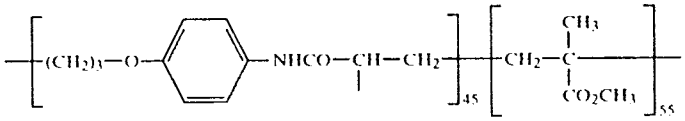 |

-continued
| Coupler | $R_1$ | Z | $R_2$ |
|---|---|---|---|
| C-46 | $-CH_3$ | $-Cl$ | 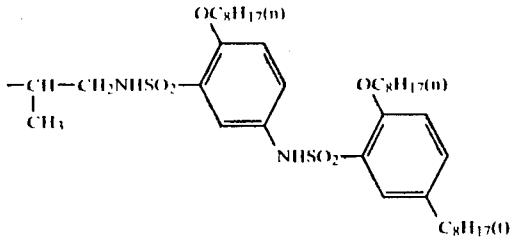 |
| C-47 | $-C_2H_5$ | $-Cl$ | 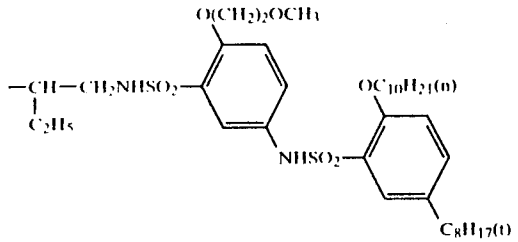 |
| C-48 | $-CH_3$ | 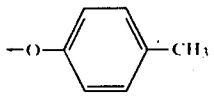 | 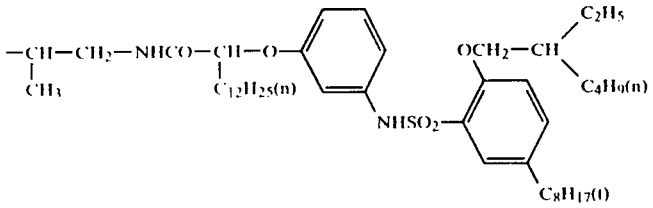 |
| C-49 | $-CH_3$ | $-Cl$ | 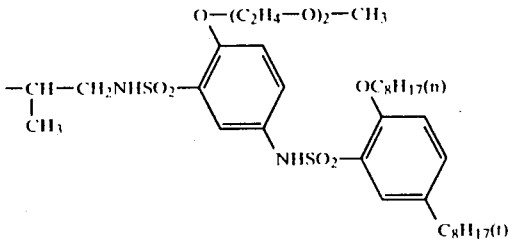 |

-continued
| Coupler | $R_1$ | Z | $R_2$ |
|---|---|---|---|
| C-50 | $-CH_3$ | $-Cl$ | 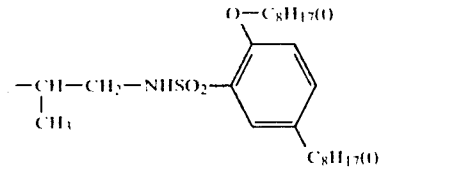 |
| C-51 | $-CH_3$ | 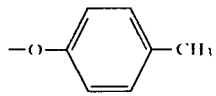 | 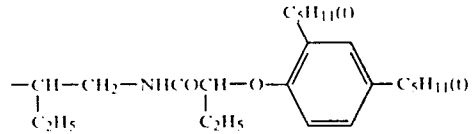 |
| C-52 | $-C(CH_3)_2-CH_2-OH$ | 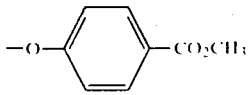 | 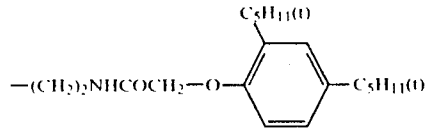 |
| C-53 | $-C(CH_3)_2COOC_2H_5$ | $-Cl$ | 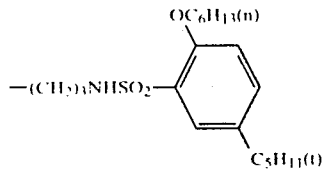 |
| C-54 | $-CH_3$ | $-Cl$ | 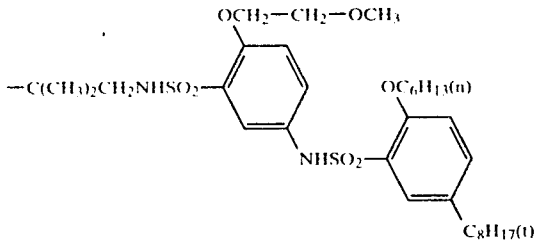 |

Typical examples of the phenol compounds of the formula III according to the invention are listed below.

(III)

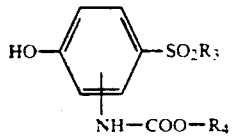

| | $R_3$ | $R_4$ |
|---|---|---|
| OF 1 | 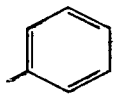 | -n-$C_{12}H_{25}$ |
| OF 2 | 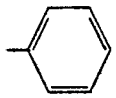 | $-CH_2-CH(C_8H_{17}(n))_2$ |
| OF 3 | 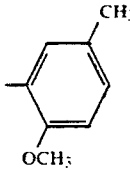 | -n-$C_{12}H_{25}$ |
| OF 4 | 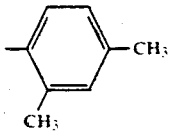 | $-CH_2-CH(C_8H_{17}(n))_2$ |
| OF 5 | $-C_2H_5$ | $-CH_2-CH(C_8H_{17}(n))_2$ |
| OF 6 | $-C_4H_9$ | $-CH_2-CH(C_8H_{17}(n))_2$ |
| OF 7 | $-C_2H_5$ | $-CH_2-CH(C_5H_{11}(n))_2$ |
| OF 8 | $-C_2H_5$ | -n-$C_{16}H_{33}$ |
| OF 9 | $-C_2H_5$ | $-CH_2-CH(C_9H_{19}(n))_2$ |

The preparation of the magenta couplers is known, for example, from EP-A-145 342. The phenolic compounds according to formula (III) are prepared by known methods. A typical method is described in the examples.

The silver halide can be in the form of predominantly compact crystals which are e.g. regularly cubic or octahedral or can exhibit transition forms. Preferably, however, platelet-shaped crystals can also be present, in which the average ratio of the diameter to the thickness is preferably at least 5:1, the diameter of a grain being defined as the diameter of a circle with a circle content corresponding to the projected area of the grain. However, the layers can also contain tablet-shaped silver halide crystals in which the ratio of the diameter to the thickness is greater than 5:1, e.g. 12:1 to 30:1.

The silver halide grains can also have a multi-layered grain build-up, in the simplest case with an inner and an outer grain region (core/shell), the halide composition and/or other modifications, such as e.g. dopings, of the individual grain regions varying. The average grain size of the emulsions is preferably between 0.2 μm and 2.0 μm, and the grain size distribution can be either homo- or heterodisperse. In addition to the silver halide, the emulsions can also contain organic silver salts, e.g. silver benzotriazolate or silver behenate.

Two or more types of silver halide emulsions, which are prepared separately, an be used as a mixture.

The photographic emulsions can be prepared from soluble silver salts and soluble halides by various methods (e.g. P. Glafkides, Chimie et Physique Photographique (Photographic Chemistry and Physics), Paul Montel, Paris (1967), G. F. Duffin, Photographic Emulsion Chemistry, The Focal Press, London (1966) V. L. Zelikman et al, Making and Coating Photographic Emulsion, The Focal Press, London (1966)).

The precipitation of the silver halide is preferably carried out in the presence of the binder, e.g. the gelatin, and can be carried out in the acid, neutral or alkaline pH range, silver halide complexing agents preferably additionally being used. The latter include e.g. ammonia, thioethers, imidazole, ammonium thiocyanate or excess halide. The water-soluble silver salts and the halides are optionally brought together in succession by the single jet process or simultaneously by the double jet process or by any desired combination of the two processes. Metering with increasing flow rates is preferred, during which the "critical" feed rate, at which the formation of new seeds is just absent, should not be exceeded. The pAg range can vary within wide limits during the precipitation, and the so-called pAg-controlled process in which a certain pAg value is kept constant or passes through a defined pAg profile during the precipitation is preferably used. In addition to preferred precipitation with excess halide, the so-called inverse precipitation with excess silver ions is also possible. As well as by precipitation, the silver halide crystals can also grow by physical ripening (Ostwald ripening) in the presence of excess halide and/or silver halide complexing agents. The growth of eh emulsion grains can even predominantly take place by Ostwald ripening, a fine-grained so-called Lippmann emulsion preferably being mixed with a sparingly soluble emulsion and redissolved with the latter.

Salts or complexes of metals, such as Cd, Zn, Pb, Tl, Bi, Ir, Rh and Fe, can also be present during the precipitation and/or the physical ripening of the silver halide grains.

The precipitation can furthermore also be carried out in the presence of sensitizing dyestuffs. Complexing agents and/or dyestuffs can be rendered inactive at any desired time, e.g. by changing the pH or by oxidative treatment The silver halides can be e.g. silver bromide, silver bromide-iodide with iodide contents of 0.1 to 40 mol %, silver chloride, silver chloride-bromide with bromide contents of 1 to 80 mol % and silver bromide-iodide-chloride with a predominant content of bromide.

Gelatin is preferably used as the binder. However, all or some of this can be replaced by other synthetic, semi-synthetic or naturally occurring polymers. Examples of synthetic gelatin substitutes are polyvinyl alcohol, poly-N-vinylpyrolidone, polyacrylamides, polyacrylic acid and derivatives thereof, in particular copolymers thereof. Examples of naturally occurring gelatin substitutes are other proteins, such as albumin or casein, cellulose, sugars, starch or alginates. Semi-synthetic gelatin substitutes are as a rule modified natural products. Cellulose derivatives, such as hydroalkylcellulose, carboxymethylcellulose and phthalylcellulose, and gelatin derivatives which have been obtained by reaction with alkylating or acylating agents or by grafting on polymerizable monomers are examples of these.

The binders should have an adequate amount of functional groups, so that sufficiently resistant layers can be produced by reaction with suitable hardening agents. Such functional groups are, in particular, amino groups, and also carboxyl groups, hydroxyl groups and active methylene groups.

The gelatin preferably used can be obtained by acid or alkaline breakdown. The preparation of such gelatin is described, for example, in The Science and Technology of Gelatine, published by A. G. Ward and A. Courts, Academic Press 1977, page 295 et seq. The particular gelatin employed should contain the lowest possible content of photographically active impurities (inert gelatin). Gelatins of high viscosity and low swelling are particularly advantageous. The gelatin can be partly or completely oxidized.

When the crystal formation has ended or even at an earlier point in time, the soluble salts are removed from the emulsion, e.g. by forming noodles and washing, by flocculation and washing, by ultrafiltration or by ion exchangers.

The photographic emulsions can contain compounds for preventing fog formation or for stabilizing the photographic function during production, storage or photographic processing.

Particularly suitable compounds are azaindenes, preferably tetra- and pentaazaindenes, in particular those which are substituted by hydroxyl or amino groups. Such compounds have been described e.g. by Birr, Z. Wiss. Phot. 47 (1952), p. 2-58. Salts of metals, such as mercury or cadmium, aromatic sulphonic or sulphinic acids, such as benzenesulphinic acid, or nitrogen-containing heterocyclic compounds, such as nitrogenzimidazole, nitroindazole, (subst.) benzotriazoles or benzothiazolium salts, can furthermore be employed as anti-fog agents. Heterocyclic compounds containing mercapto groups, e.g. mercaptobenzothiazoles, mercaptobenzimidazoles, mercaptotetrazoles, mercaptothiadiazoles and mercaptopyrimidines, are particularly suitable, it also being possible for these mercaptoazoles to contain a group which confers water-solubility, e.g. a carboxyl group or sulpho group. Other suitable compounds are disclosed in Research Disclosure No. 17643 (1978), section VI.

The stabilizers can be added to the silver halide emulsions before, during or after ripening thereof. The compounds can of course also be added to other photographic layers assigned to a silver halide layer.

It is also possible to employ mixtures of two or more of the compounds mentioned.

The silver halide emulsions are usually ripened chemically, for example by the action of gold compounds or compounds of divalent sulphur.

The photographic emulsion layers or other hydrophilic colloid layers of the photosensitive material prepared according to the invention can contain surface-active agents for various purposes, such as coating aids, for prevention of electric charging, for improvement of the sliding properties, for emulsification of the dispersion, for prevention of adhesion and for improvement of photographic characteristics (e.g. development acceleration, high contrast, sensitization etc).

The photographic emulsion can be sensitized spectrally using methine dyestuffs or other dyestuffs. Particularly suitable dyestuffs are cyanine dyestuffs, merocyanine dyestuffs and complex merocyanine dyestuffs.

Sensitizers can be dispensed with if the intrinsic sensitivity of the silver halide is adequate for a certain spectral range, for example the blue sensitivity of silver bromide.

Color photography materials usually contain at least in each case one red-sensitive, green-sensitive and blue-sensitive emulsion layer. Non-diffusing monomeric or polymeric color couplers are assigned to these emulsion layers and can be in the same layer or in a layer adjacent thereto. Usually, cyan couplers are assigned to the red-sensitive layers, magenta couplers are assigned to the green-sensitive layers and yellow couplers are assigned to the blue-sensitive layers, according to the invention magenta couplers of the formula (I) or (II) being used exclusively or as a mixture with other magenta couplers described below.

Color couplers for producing the cyan part color image are as a rule couplers of the phenol or α-naphthol type; suitable examples of these are known in the literature.

Color couplers for producing the yellow part color image are as a rule couplers having an open-chain ketomethylene grouping, in particular couplers of the α-acylacetamide type; suitable examples of these are α-benzoylacetanilide couplers and α-pivaloylacetanilide couplers, which are likewise known from the literature.

Color couplers for producing the magenta part color image are as a rule couplers of the 5-pyrazoone, indazolone or pyrazoloazole type; a large number of suitable examples of these are described in the literature.

The color couplers can be 4-equivalent couplers or 2-equivalent couplers. The latter are derived from the 4-equivalent couplers in that they contain in the coupling position a substituent which is split off during coupling. The 2-equivalent couplers include those which are colorless, and also those which have an intense intrinsic color which disappears, or is replaced by the color of the image dyestuff produced, during color coupling (mask couplers), and the white couplers, which give essentially colorless products during reaction with color developer oxidation products. The 2-equivalent couplers furthermore include those couplers which contain in the coupling site a radical which can be split off and which is released during reaction with color developer oxidation products and in this way displays a certain desired photographic activity, e.g. as a development inhibitor or accelerator, either directly or after one or more other groups have been split off from the radical primarily split off (e.g. DE-A-27 03-145, DE-A-28 55 697, DE-A-31 05 026 and DE-A-33 19 428). Examples of such 2-equivalent couplers are the known DIR couplers, and also DAR and FAR couplers.

Since in the case of the DIR, DAR and FAR couplers, chiefly the activity of the radical released during coupling is desired and it is less a matter of the color-forming properties of these couplers, those DIR, DAR and FAR couplers which produce essentially colorless products during coupling are also suitable (DE-A-1 547 640).

The radical which can be split off can also be a ballast radical, so that coupling products which are capable of diffusion or have at least a slight or limited mobility are obtained during reaction with color developer oxidation products (US-A-4 420 556).

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and US-A-4 080 211. The high molecular weight color couplers are as a rule prepared by polymerization of ethylenically unsaturated monomeric color couplers. However, they can also be obtained by polyaddition or polycondensation.

The couplers or other compounds can be incorporated into silver halide emulsion layers in a manner in which a solution, a dispersion or an emulsion of the compound in question is first prepared and the casting solution for the layer in question is then added. The choice of suitable solvent or dispersing agent depends on the particular solubility of the compound.

Methods for incorporation of compounds which are essentially insoluble in water by grinding processes are described, for example, in DE-A-2 609 741 and DE-A-2 609 742.

Hydrophobic compounds can also be introduced into the casting solution using high-boiling solvents, so-called oil-forming agents. Corresponding methods are described, for example, in US-A-2 322 027, US-A-2 801 170, US-A-2 801 171 and EP-A-0 043 037.

Instead of the high-boiling solvents, oligomers or polymers, so-called polymeric oil-forming agents, can be used.

The compounds can also be introduced into the casting solution in the form of charged latices. Reference is made, for example, to DE-A-2 541 230, DE-A-2 541 274, DE-A-2 835 856, EP-A-0 014 921, EP-A-0 069 671, EP-A-0 130 115 and US-A-4 291 113.

It should also be noted, however, that according to the invention couplers of the formula (I) or (II) can be introduced into a casting solution, and thus into an emulsion layer, using compounds of the formula (III).

The diffusion-resistant incorporation of anionic water-soluble compounds (e.g. dyestuffs) can also be effected with the aid of cationic polymers, so-called mordant polymers.

Suitable oil-forming agents for other couplers and other compounds are e.g. alkyl phthalates, phosphoric acid esters, citric acid esters, benzoic acid esters, alkylamides, fatty acid esters and trimesic acid esters.

Color photography material typically includes at least one red-sensitive emulsion layer, at least one green-sensitive emulsion layer and at least one blue-sensitive emulsion layer on supports. The sequence of these layers can be varied as required. Couplers which form cyan, magenta and yellow dyestuffs are usually incorporated into the red-, green- and blue-sensitive emulsion layers respectively. However, it is also possible to use different combinations.

Each of the photosensitive layers can consist of a single layer or also comprise two or more silver halide emulsion part layers (DE-C-1 121 470). Red-sensitive silver halide emulsion layers are often positioned closer to the layer support there than green-sensitive silver halide emulsion layers, and these in turn are closer than blue-sensitive layers, a non-photosensitive yellow filter layer in general being between the green-sensitive layers and blue-sensitive layers.

If the green- or red-sensitive layers are of suitably low intrinsic sensitivity, it is possible to dispense with the yellow filter layer and choose other layer arrangements in which e.g. the blue-sensitive, then the red-sensitive and finally the green-sensitive layers follow on the support.

The non-photosensitive intermediate layers as a rule positioned between layers of different spectral sensitivity an contain agents which prevent undesirable diffusion of developer oxidation products from one photosensitive into another photosensitive layer of different spectral sensitization.

If several part layers of the same spectral sensitization are present, these can differ in respect of their composition, in particular as regards the nature and amount of the silver halide grains. The part layer of higher sensitivity is in general positioned further from the support than the part layer of lower sensitivity. Part layers of the same spectral sensitization can be adjacent to one another or separated by other layers, e.g. by layers of different spectral sensitization. Thus e.g. all the high-sensitivity and all the low-sensitivity layers can in each case be combined into one layer package (DE-A 1 958 709, DE-A 2 530 645 and DE-A 2 622 922).

The photographic material can furthermore contain compounds which absorb UV lights, whiteners, spacers, filter dyestuffs, formalin collectors and others.

Compounds which absorb UV light should on the one hand protect the image dyestuffs from bleaching by UV-rich daylight and on the other hand, as filter dyestuffs, absorb the UV light in daylight during exposure and in this way improve the color reproduction of a film. Compounds of different structure are usually employed for the two tasks. Examples are aryl-substituted benzotriazole compounds (US-A 3 533 794), 4-thiazolidone compounds (US-A 3 314 794 and 3 352 681), benzophenone compounds (JP-A 2784/71), cinnamic acid ester compounds (US-A 3 705 805 and 3 707 375), butadiene compounds (US-A 4 045 229) or benzoxazole compounds (US-A 3 700 455).

It is also possible to use ultraviolet-absorbing couplers (such as cyan couplers of the $\alpha$-naphthol type) and ultraviolet-absorbing polymers. These ultraviolet-absorbing agents can be fixed by mordanting in a special layer.

Filter dyestuffs which are suitable for visible light include oxonol dyestuffs, hemioxonol dyestuffs, styrene dyestuffs, merocyanine dyestuffs, cyanine dyestuffs and azo dyestuffs. Of these dyestuffs, oxonol dyestuffs, hemioxonol dyestuffs and merocyanine dyestuffs are particularly advantageously used.

Suitable whiteners are described e.g. in Research Disclosure December 1978, page 22 et seq., paper 17 643, chapter V.

Certain binder layers, in particular the layer furthest removed from the support, but also occasionally intermediate layers, especially if they are the layer furthest removed from the support during preparation, can contain photographically inert particles of an inorganic or organic nature, e.g. as matting agents or as spacers (DE-A 3 331 542, DE-A 3, 424 893 and Research Disclosure December 1978, page 22 et seq., paper 17 643, chapter XVI).

The average particle diameter of the spacers is in particular in the range from 0.2 to 10 μm. The spacers are water-soluble and can be alkali-insoluble or alkali-soluble, the alkali-soluble spacers in general being removed from the photographic material in the alkaline development bath. Examples of suitable polymers are polymethyl methacrylate, copolymers of acrylic acid and methyl methacrylate and hydroxypropylmethylcellulose hexahydrophthalate.

The binders of the material according to the invention, in particular if gelatin is employed as the binder, are hardened with suitable hardeners, for example with hardeners of the epoxide type, the ethyleneimine type, the acryloyl type or the vinylsulphone type. Hardeners of the diazine, triazine or 1,2-dihydroquinoline series are also suitable.

The binders of the material according to the invention are preferably hardened with immediate hardeners.

Immediate hardeners are understood as compounds which crosslink suitable binders to that immediately after coating, at the latest after 24 hours and preferably at the latest after 8 hours, hardening is concluded to the extend that no further change in the sensitometry and the swelling of the layer combination caused by the crosslinking reaction occurs. Swelling is understood as the difference between the wet layer thickness and dry layer thickness during aqueous processing of the film (photogr. Sci. Eng. 8 (1964), 275; and Photogr. Sci. Eng. (1972), 449).

These hardening agents which react very rapidly with gelatin are e.g. carbamoylpyridinium salts which are capable of reacting with fee carboxyl groups of the gelatin, so that the latter react with free amino groups of the gelatin to form peptide bonds and crosslink the gelatin.

Suitable examples of immediate hardeners are e.g. compounds of the general formulae

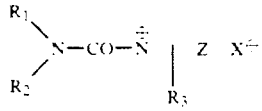

(a)

wherein $R_1$ denotes alkyl, aryl or aralkyl, $R_2$ has the same meaning as $R_1$ or denotes alkylene, arylene, aralkylene or alkaralkylene, the second bond being linked to a group of the formula

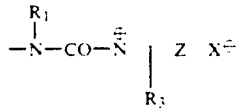

or $R_1$ and $R_2$ together denote the atoms required to complete an optionally substituted heterocyclic ring, for example a piperidine, piperazine or morpholine ring, it being possible for the ring to be substituted e.g. by $C_1$-$C_3$-alkyl or halogen, $R_3$ represents hydrogen, alkyl, aryl, alkoxy, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or a bridge member or a direct bond to a polymer chain, wherein $R_4$, $R_6$, $R_7$, $R_9$, $R_{14}$, $R_{15}$, $R_{17}$, $R_{18}$ and $R_{19}$ denote hydrogen or $C_1$-C hd 4-alkyl, $R_5$ denotes hydrogen, $C_1$-$C_4$-alkyl or $NR_6R_7$, $R_8$ denotes $—COR_{10}$, $R_{10}$ denotes $NR_{11}R_{12}$, $R_{11}$ denotes $C_1$-$C_4$-alkyl or aryl, in particular phenyl, $R_{12}$ denotes hydrogen, $C_1$-$C_4$-alkyl or aryl, in particular phenyl, $R_{13}$ denotes hydrogen, $C_1$-$C_4$-alkyl or aryl, in particular phenyl, $R_{16}$ denotes hydrogen, $C_1$-$C_4$-alkyl, $COR_{18}$ or $CONHR_{19}$, m denotes a number from 1 to 3, n denotes a number from 0 to 3, p denotes a number from 2 to 3 and Y denotes O or $NR_{17}$, or $R_{13}$ and $R_{14}$ together represent the atoms required to complete an optionally substituted heterocyclic ring, for example a piperidine, piperazine or morpholine ring, it being possible for the ring to be substituted e.g. by $C_1$-$C_3$-alkyl or halogen, Z denotes the C atoms required to complete a 5- or 6-membered aromatic heterocyclic ring, optionally with a fused-on benzene ring, and $Z^{\oplus}$ denotes an anion, which is absent if an anionic group is already linked to the remainder of the molecule;

and

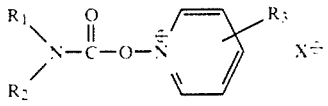

(b)

wherein $R_1$, $R_2$, $R_3$ and $X^{\ominus}$ have the meaning given for formula (a).

The materials according to the invention, whether color negative or color reversal films, color negative or color reversal paper or direct positive materials, are processed in the customary manner by the processes recommended for these materials.

EXAMPLE 1

In each case 8 mmol magenta coupler (see Table 1) were dissolved in hot ethyl acetate (EA) at about 50° C. and oil-forming agents (OF; see Table 1) and di-n-octyl sulphosuccinate (emulsifier) were added, so that a weight ratio of coupler: OF:EA:emulsifier = 1:1:3:0.1 resulted. The mixture was then emulsified in 7.5 wt. % gelatin solution. Depending on the molecular weight, a ratio of coupler:gelatin of about 1:2 results.

The emulsified mixture was stirred at 1,000 rpm for 6 min, during which it heated up to about 50° C., the EA being distilled off in a water pump vacuum (200-300 mbar).

The quality of the fresh emulsified mixtures of the couplers was evaluated with the aid of a phase contrast or polarization microscope as follows:

a) Particle size
1: very fine (<0.5 μm)
2: fine (<1.0 μm)
3: fine with a few larger particles
4: medium
5: coarse b) Homogeneity
1: no crystals detectable
2: isolated crystals detectable
3: many crystals detectable
4: marked crystallization The same evaluation was made after the emulsified mixtures had been stirred intensively at 50° C. for 3 h and 6 h.

Comparison couplers

V1

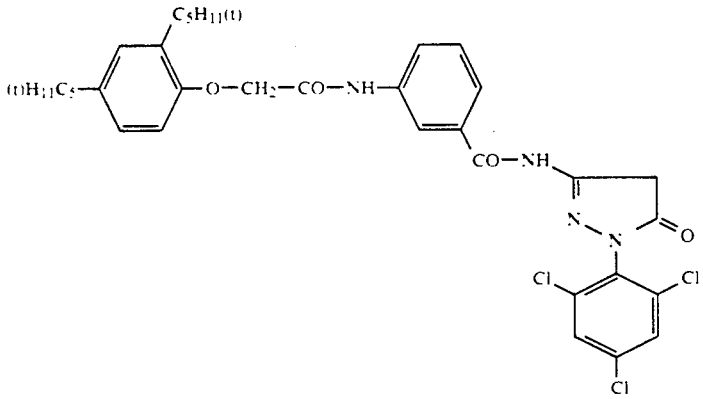

V2

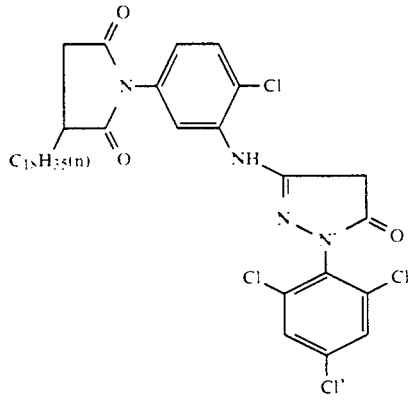

V3

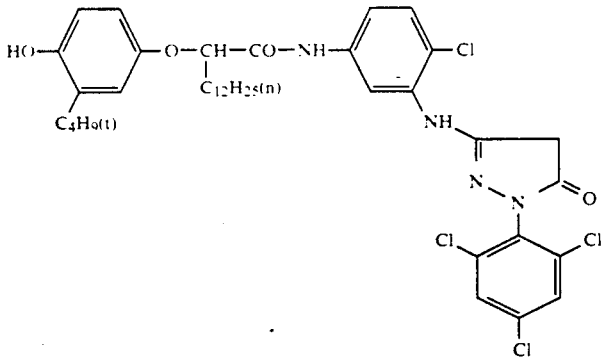

V4

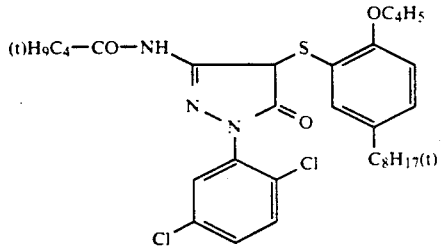

-continued

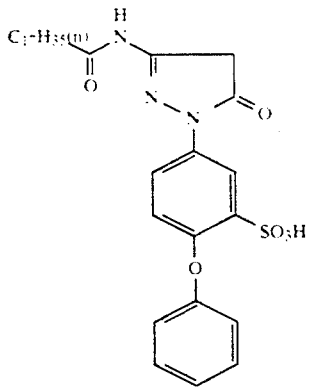

V5

Comparison oil-forming agents

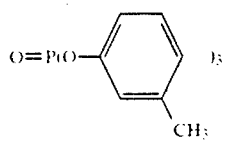

VO 1

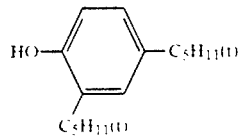

VO 2

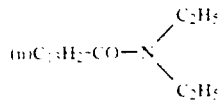

VO 3

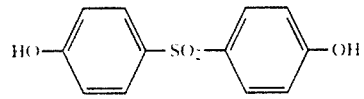

VO 4

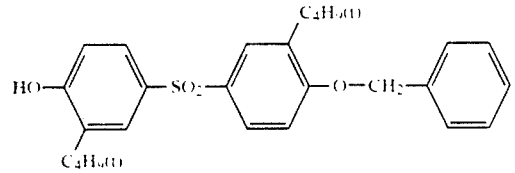

VO 5

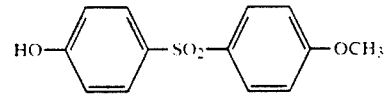

VO 6

TABLE 1

| Coupler | Oil-forming agent | Quality of the coupler emulsion mixture: fresh a | fresh b | 3 h/50° C a | 3 h/50° C b | 6 h/50° C. a | 6 h/50° C. b |
|---|---|---|---|---|---|---|---|
| V 1 | VO 1 | 2 | 2 | 3 | 3 | 5 | 4 |
| V 1 | OF 5 | 1 | 2 | 3 | 3 | 4 | 3 |
| V 2 | VO 2 | 3 | 3 | 3 | 3 | 3 | 4 |
| V 2 | OF 5 | 2 | 2 | 3 | 3 | 3 | 4 |
| V 3 | VO 4 | 2 | 2 | 2 | 2 | 4 | 4 |
| V 3 | OF 5 | 2 | 3 | 3 | 4 | 4 | 4 |
| V 4 | VO 3 | 3 | 3 | 3 | 4 | 4 | 4 |
| V 4 | OF 5 | 2 | 2 | 2 | 3 | 4 | 4 |
| V 5 | VO 5 | 3 | 3 | 3 | 4 | 3 | 4 |
| V 5 | OF 5 | 3 | 4 | 3 | 4 | 4 | 4 |
| C 1 | VO 6 | 3 | 3 | 3 | 4 | 4 | 4 |

TABLE 1-continued

| | Coupler | Oil-forming agent | Quality of the coupler emulsion mixture: fresh a | fresh b | 3 h/50° C. a | 3 h/50° C. b | 6 h/50° C. a | 6 h/50° C. b |
|---|---|---|---|---|---|---|---|---|
| | C 1 | VO 1 | 3 | 4 | 3 | 4 | 5 | 4 |
| | C 1 | VO 3 | 3 | 3 | 3 | 3 | 4 | 3 |
| | C 1 | VO 2 | 2 | 4 | 4 | 4 | 4 | 4 |
| according to the invention | C 1 | OF 5 | 1 | 1 | 1 | 2 | 2 | 2 |
| | C 9 | VO 2 | 3 | 3 | 3 | 4 | 4 | 4 |
| according to the invention | C 9 | OF 5 | 1 | 2 | 1 | 2 | 2 | 2 |
| according | C 9 | OF 2 | 1 | 1 | 1 | 1 | 1 | 2 |

TABLE 1-continued

| | Coupler | Oil-forming agent | Quality of the coupler emulsion mixture fresh a | fresh b | 3 h 50° C. a | 3 h 50° C. b | 6 h 50° C. a | 6 h 50° C. b |
|---|---|---|---|---|---|---|---|---|
| to the invention according to the invention | C 9 | OF 9 | 1 | 2 | 1 | 2 | 2 | 2 |
| | C 14 | VO 6 | 3 | 3 | 3 | 4 | 4 | 4 |
| according to the invention | C 14 | OF 5 | 1 | 1 | 1 | 1 | 1 | 2 |
| | C 17 | VO 1 | 4 | 1 | 4 | 3 | 4 | 4 |
| according to the invention | C 17 | OF 5 | 1 | 1 | 1 | 1 | 1 | 2 |

EXAMPLE 2

The emulsified mixtures prepared according to example 1 were mixed with a silver bromide-iodide emulsion (0.7 mol % iodide) in a ratio of 1 mol coupler:5.2 mol $AgNO_3$ and the mixture was applied to a layer support of cellulose acetate and covered with a protective layer of a 3 wt. % gelatin solution which contained, as the hardening agent, the compound of the formula

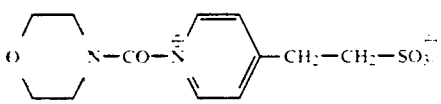

After drying and cutting, the samples thus prepared were exposed behind a step wedge and processed by the Negative-AP 70 process (38° C.).

| Bath | min |
|---|---|
| Colour developer (CD 70) | 3.25 |
| Bleaching bath | 6.5 |
| Washing | 3.0 |
| Fixing bath | 6.5 |
| Washing | 6.0 |

The following baths were used:

Color Developer 8,000 ml water
17 g Na hydroxyethanediphosphonate
12 g ethylenediaminetetraacetic acid (EDTA acid)
47 g 1-(N-ethyl-N-hydroxyethyl)-3-methyl-p-phenylenediamine
25 g hydroxylammonium sulphate
39 g sodium sulphite
15.5 g sodium bicarbonate
335 g potassium carbonate
13.5 g potassium bromide make up to 10 l with water; pH 10.0

Bleaching Bath 8,000 ml water
1,390 g ammonium bromide
865 g $NH_4$-Fe EDTA
163 g EDTA acid
100 g ammonia
make up to 10 l with water and adjust to pH 6.0±0.1 with about 15 ml glacial acetic acid

Fixing Bath 8,000 ml water
1,500 g ammonium thiosulphate
100 g sodium sulphite
20 g sodium hexamethaphosphate make up to 10 l with water; pH 7.5.

The abbreviations have the following meanings:
S Sensitivity in DIN units
$\nu$gradient of the linear part of the characteristic curve
CY color yield in $D_{max}$/Ag applied
F fog

TABLE 2

| Coupler | Oil-forming agent | S | $\nu$ | CY | F |
|---|---|---|---|---|---|
| V 1 | VO 1 | ±0 (type) | 0.5 | 1.40 | 0.13 |
| V 1 | OF 5 | −1.3 | 0.65 | 2.10 | 0.14 |
| C 1 | VO 3 | −3.0 | 0.30 | 1.43 | 0.12 |
| C 1 | OF 5 | −2.1 | 1.05 | 3.10 | 0.11 |
| C 20 | OF 5 | −1.9 | 1.10 | 3.20 | 0.10 |
| C 14 | VO 4 | −5.0 | 0.57 | 1.82 | 0.13 |
| C 14 | OF 5 | −3.0 | 1.05 | 3.30 | 0.10 |

Table 2 shows that, in comparison with the couplers and oil-forming agents of the prior art, the combination according to the invention are distinguished by a high sensitivity steep gradation and high color yield with comparable fresh fog values.

EXAMPLE 3

Individual layers, prepared according to example 2, of eh couplers and oil-forming agents listed in Table 3 were exposed to a formalin concentration of 10 ppm at 70% rel. atmospheric humidity for 0, 3, 7, 14 and 21 days before exposure and processing according to example 2.

The following color density values resulted after processing:

TABLE 3

| Coupler | Oil-forming agent | $D_{max}$ after action of $CH_2$—O 0 | 3 | 7 | 14 | 21 days |
|---|---|---|---|---|---|---|
| V 1 | VO 1 | 2.2 | 2.0 | 1.6 | 1.10 | 0.8 |
| V 1 | VO 4 | 2.4 | 2.4 | 2.0 | 1.4 | 0.9 |
| V 1 | OF 5 | 2.4 | 2.0 | 1.6 | 1.2 | 0.8 |
| C 1 | VO 4 | 1.2 | 1.2 | 1.1 | 1.0 | 0.8 |
| C 1 | OF 5 | 2.9 | 2.9 | 2.85 | 2.75 | 2.70 |

EXAMPLE 4

A color photography recording material for negative color development was prepared by applying the following layers in the sequence shown to a transparent layer support of cellulose triacetate. The amounts stated in each case relate to 1 $m^2$. For the silver halide application, the corresponding amounts of $AgNO_3$ are stated. All the silver halide emulsions were stabilized with 0.5 g 4-hydroxy-6-methyl-1,3,4*a*,7-tetraazaindene per 100 g $AgNO_3$.

Layer 1 (antihalogen layer)
black colloidal containing silver sol
0.18 g Ag
0.30 g UV absorber UBv-1
1.5 g gelatin Layer 2 (intermediate layer)
silver bromide-iodide emulsion (0.8 mol % iodide) from 0.15 g $AgNO_3$, containing
0.15 g 2,5-dioctylhydroquinone
0.11 g coupler BG 1

0.3 g gelatin

Layer 3 (1st red-sensitized layer)

red-sensitized silver bromide-iodide emulsion (b 5 mol% iodide) from 0.7 g $AgNO_3$, containing 0.1 g coupler BG 2

0.3 g coupler BG 3

0.01 g coupler BG 4

1.2 g gelatin

Layer 4 (2nd red-sensitized layer)

red-sensitized silver bromide-iodide emulsion (10 mol % iodide) from 1.2 g $AgNO_3$, containing 0.1 g coupler BG 2

0.05 g coupler BG 3

0.05 g coupler BG 5

0.9 g gelatin

Layer 5 (3rd red-sensitized layer)

red-sensitized silver bromide-iodide emulsion (10 mol % iodide) from 2.0 g $AgNO_3$, containing 0.05 g coupler BG 3

0.15 g coupler BG 5

0.003 g coupler DIR 1

0.8 g gelatin

Layer 6 (intermediate layer) 0.5 g gelatin

Layer 7 (1st green-sensitized layer)

green-sensitized silver bromide-iodide emulsion (5 mol % iopdide) from 0.5 g $AgNO_3$, containing 0.3 g coupler V1 in VO 1

0.4 g coupler MG 1

0.5 g coupler MG 2

0.5 g coupler DIR 2

1.2 g gelatin

Layer 8 (2nd green-sensitized layer)

green-sensitized silver bromide-iodide emulsion (6 mol % iodide) from 1.0 g $AgNO_3$, containing 0.25 g coupler V1 in Vo1

0.01 g coupler MG1

0.01 g coupler MG2

0.01 g coupler DIR 2

1.7 g gelatin

Layer 9 (3rd green-sensitive layer)

green-sensitized silver bromide-iodide emulsion (10 mol % iodide) from 1.5 g $AgNO_3$containing 0.015 g coupler MG 1

0.07 g coupler V1 in VO 1

0.002 g coupler DAR 1

1.0 g gelatin

Layer 10 (yellow filter layer)

yellow colloidal silver sol from 0.05 g Ag, containing 0.03 g 3,5-fitert.-octylhydroquinone and 0.6 g gelatin Layer 11 (1st blue-sensitive layer)

silver bromide-iodide emulsion (5 mol % iodide) from 0.3 g $AgNO_3$, containing 0.7 g coupler Y1

0.03 g coupler DIR 3

1.4 g gelatin

Layer 12 (2nd blue-sensitive layer)

silver bromide-iodide emulsion (5 mol % iodide) from 0.3 g $AgNO_3$, containing 0.25 g coupler Y1

0.6 g gelatin

Layer 13 (Mikrat layer)

silver bromide-iodide emulsion (2 mol % iodide) from 0.4 g $AgNO_3$, containing 0.1 g gelatin Layer 14 (3rd blue-sensitive layer)

silver bromide-iodide emulsion (10 mol % iodide) from 0.8 g $AgNO_3$, containing 0.2 g coupler Y1

0.5 g gelatin

Layer 15 (1st protective layer)

0.14 g UV absorber UV-1

0.20 g UV absorber UV-2

0.4 g gelatin

Layer 16 (2nd protective layer)

0.95 g hardening agent according to example 2

0.23 g gelatin.

The recording material prepared in this way is called material A (not according to the invention). A material B according to the present invention which differed from material A only in that the coupler C2 in OF 5 instead of V1 in VO 1 was used in layers 7, 8 and 9 was prepared in the same manner.

After exposure and processing as described in example 2, the following sensitometric data were obtained. The values which were obtained when materials A and B had been stored in a drying cabinet (35° C.; 85% rel. humidity) for 1 week before the exposure are shown in parentheses.

| | Coupler | Oil-forming agent | S | $D_{max}$ | $\nu$ | F |
|---|---|---|---|---|---|---|
| A | V1 | VO 1 | ±0 type | 2.0 | 0.8 | 0.12 |
| | | | (−0.5) | (2.10) | (0.65) | (0.18) |
| B | C2 | OF 5 | −2.0 | 2.85 | 1.10 | 0.12 |
| | | | (−2.0) | (2.75) | (1.10) | (0.13) |

After the action of 10 ppm formalin at 70% rel. humidity for 21 days before exposure and processing, $D_{max}$ of material A was reduced to 0.95, and that of material B was reduced to only 2.70.

The following compounds were used:

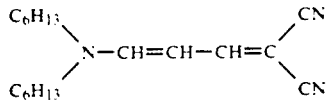

UV-1

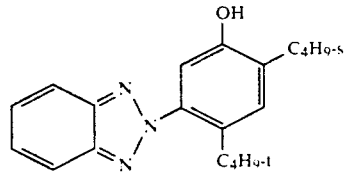

UV-2

-continued
BG 1
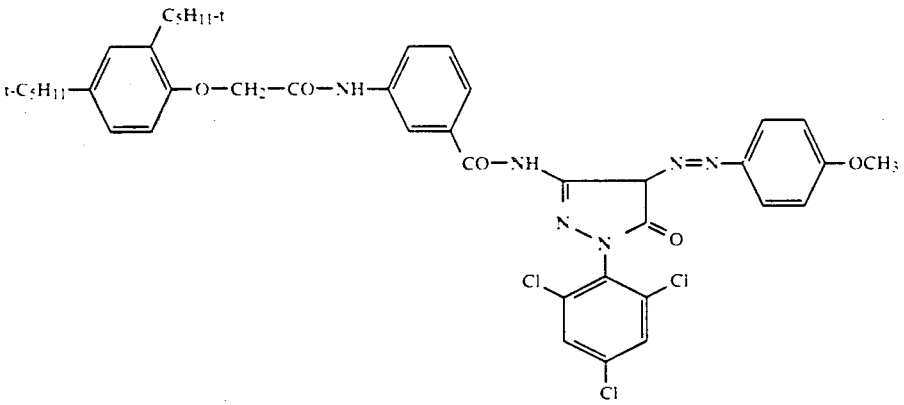
BG 2
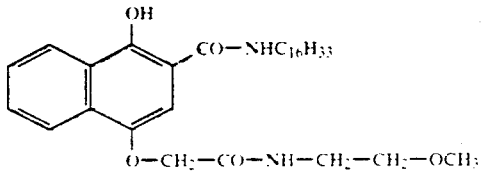
BG 3
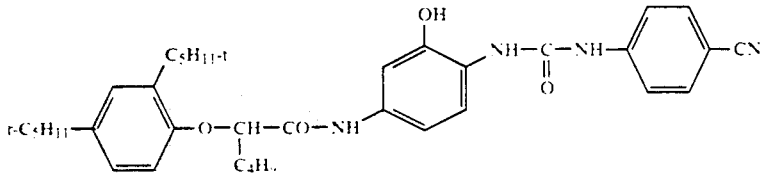
BG 4
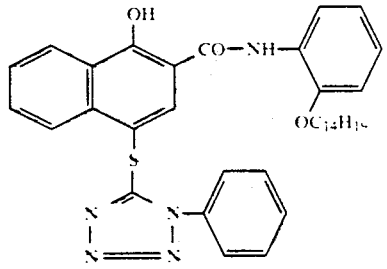
BG 5
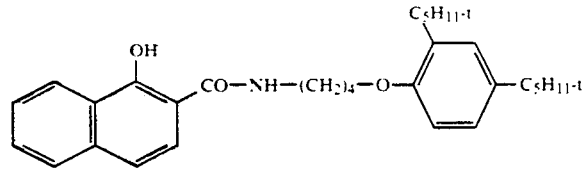
DIR 1
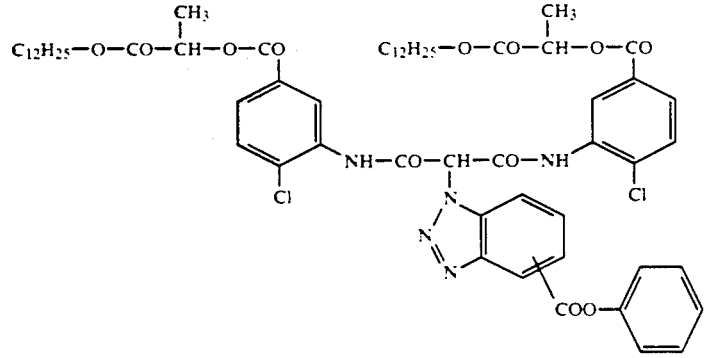

-continued
MG 1
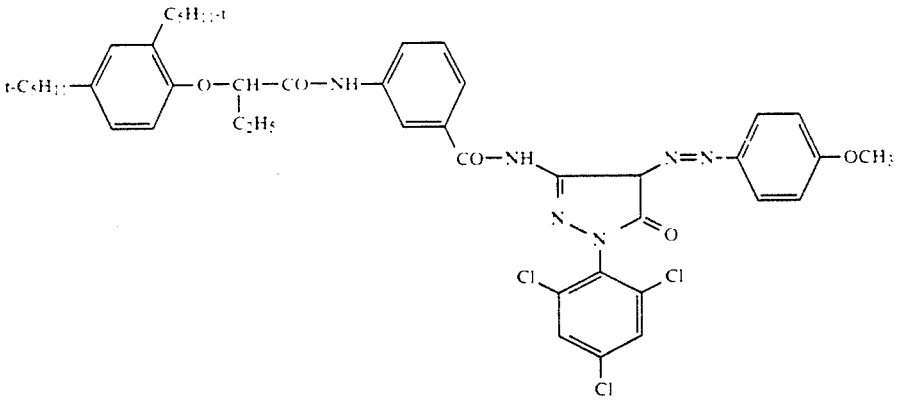
MG 2
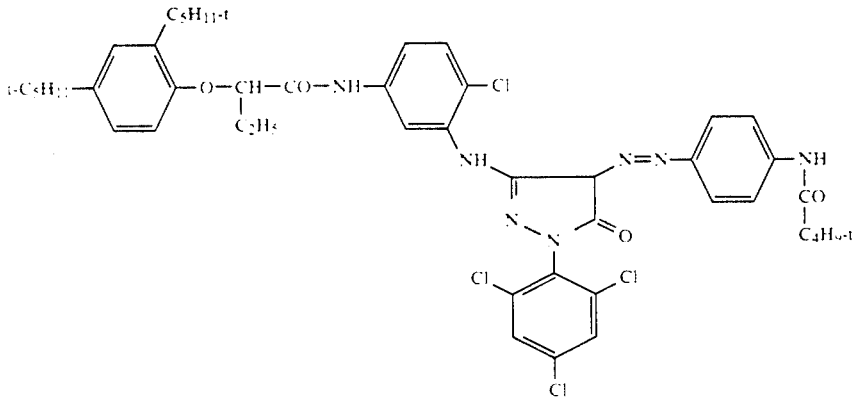
DIR 2
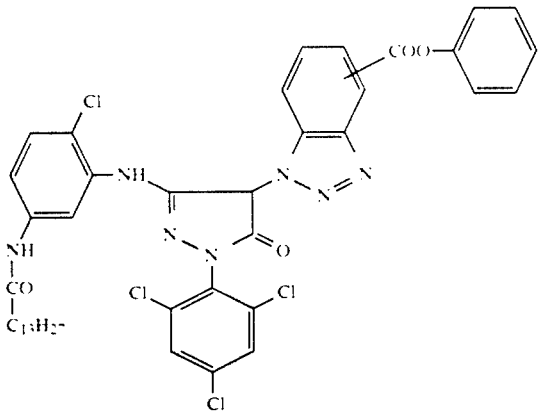
DAR 1
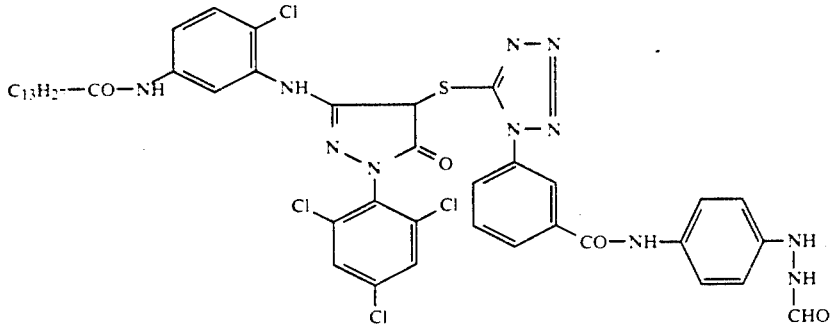

-continued

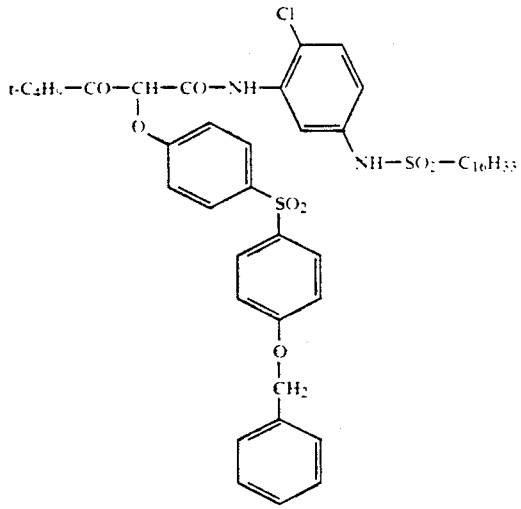

Y 1

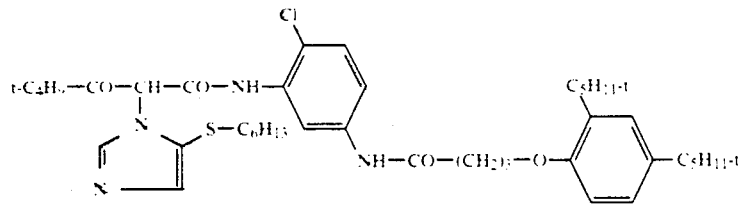

DIR 3

I claim:

1. Color photography silver halide materials which contains in at least one silver halide emulsion layer a magenta coupler of the formulae (I) or (II)

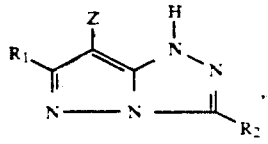

(I)

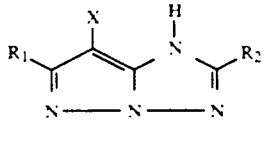

(II)

wherein $R_1$ denotes alkyl, aryl or a ballast radical, $R_2$ denotes a ballast radical, alkyl or aryl, Z denotes hydrogen or a group which can be split off during reaction with the developer oxidation product, and a compound of the formula (III)

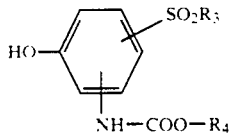

(III)

wherein $R_3$ denotes alkyl, alkoxy, aryl, optionally substituted amino or the radical of a heterocyclic compound, and wherein $R_4$ is

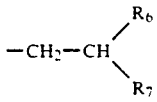

wherein $R_6$ and $R_7$ are straight-chain or branched alkyl radicals having in total 6 to 28 C atoms.

2. Color photographic silver halide material according to claim 1, wherein Z denotes halogen, an aryloxy group, an arylthio group or a heterocyclic thio group.

3. Color photographic silver halide material according to claim 1, wherein the magenta coupler corresponds to the formula (IV)

(IV)

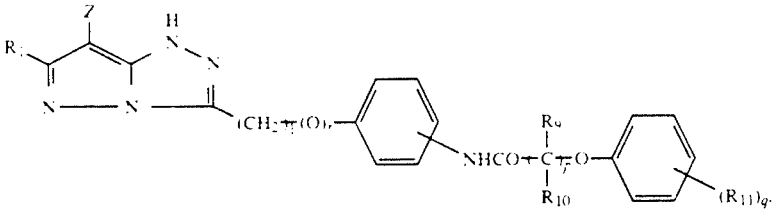

wherein

Z' is a group which is split off by reaction with the developer oxidation product, $R_9$ and $R_{10}$ denote hydrogen or alkyl, $R_{11}$ denotes alkyl, halogen or hydroxyl, l, p and q denote a number from 0 to 4 and r denotes 0 or 1.

4. Color photographic silver halide material according to claim 3, wherein l denotes a number of 0 to 3, p denotes a number from 1 to 3 and q denotes the number 1 or 2.

5. Color photographic silver halide material according to claim 1, wherein the phenol corresponds to the formula

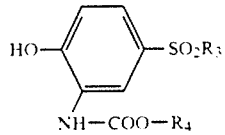

and $R_3$ and $R_4$ have the meaning as defined in claim 6.

* * * * *